US010146170B2

(12) United States Patent
Tauchi

(10) Patent No.: US 10,146,170 B2
(45) Date of Patent: Dec. 4, 2018

(54) IMAGE FORMING APPARATUS HAVING A SEAL MEMBER WHICH IS DISPOSED AT AN OPENING OF A DEVELOPING DEVICE AND OF WHICH A TIP END CONTACTS WITH AN IMAGE CARRIER

(71) Applicant: KYOCERA Document Solutions Inc., Osaka (JP)

(72) Inventor: Yasuhiro Tauchi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/727,140

(22) Filed: Oct. 6, 2017

(65) Prior Publication Data

US 2018/0136601 A1 May 17, 2018

(30) Foreign Application Priority Data

Nov. 11, 2016 (JP) ..... 2016-220862

(51) Int. Cl.

| | |
|---|---|
| ***G03G 15/02*** | (2006.01) |
| ***G03G 15/08*** | (2006.01) |
| ***G03G 21/00*** | (2006.01) |
| ***G03G 15/00*** | (2006.01) |

(52) U.S. Cl.
CPC ..... *G03G 21/0064* (2013.01); *G03G 15/0208* (2013.01); *G03G 15/0881* (2013.01); *G03G 15/0898* (2013.01); *G03G 15/50* (2013.01)

(58) Field of Classification Search
CPC ..... G03G 15/095; G03G 15/0817; G03G 21/0064; G03G 21/06
USPC ..... 399/99, 102, 103, 71, 128, 129, 43
See application file for complete search history.

(56) References Cited

U.S. PATENT DOCUMENTS

| | | | | |
|---|---|---|---|---|
| 4,888,619 | A * | 12/1989 | Tottori | G03G 15/0126 399/127 |
| 5,640,230 | A * | 6/1997 | Ono | G03G 15/0121 347/131 |
| 2006/0256399 | A1* | 11/2006 | Murakami | G03G 15/0806 358/468 |
| 2007/0172249 | A1* | 7/2007 | Chang | G03G 15/0157 399/99 |
| 2011/0116834 | A1* | 5/2011 | Kinokuni | G03G 15/0266 399/129 |
| 2012/0201575 | A1 | 8/2012 | Kashimoto et al. | 399/272 |

* cited by examiner

*Primary Examiner* — Walter L Lindsay, Jr.
*Assistant Examiner* — Arlene Heredia
(74) *Attorney, Agent, or Firm* — Stein IP, LLC

(57) ABSTRACT

An image forming apparatus includes an image carrier, an electrification device, an exposing device, developing device, and a control unit. The developing device includes a developing roller for supplying toner to the image carrier, a developing container for storing developer containing the toner, and a seal member for preventing leakage of the toner from a gap between the image carrier and the developing container. The control unit is capable of executing a seal member cleaning mode, in which it forms an electrostatic latent image pattern having exposed parts and unexposed parts whose boundaries exist at a predetermined or less interval over the entire area in a width direction of an image forming area of the image carrier when an image is not being formed, and drives the image carrier to rotate so that the electrostatic latent image pattern passes the seal member.

10 Claims, 12 Drawing Sheets

IMAGE FORMING APPARATUS HAVING A SEAL MEMBER WHICH IS DISPOSED AT AN OPENING OF A DEVELOPING DEVICE AND OF WHICH A TIP END CONTACTS WITH AN IMAGE CARRIER

INCORPORATION BY REFERENCE

This application is based upon and claims the benefit of priority from the corresponding Japanese Patent Application No. 2016-220862 filed Nov. 11, 2016, the entire contents of which are hereby incorporated by reference.

BACKGROUND

The present disclosure relates to an electrophotographic image forming apparatus including a developing device for supplying developer to an image carrier.

The electrophotographic image forming apparatus irradiates a cylindrical surface of the image carrier (a photosensitive drum) with light based on image information read from a document image or image information transmitted from an external device such as a computer so as to form an electrostatic latent image, supplies the electrostatic latent image with toner from the developing device so as to form a toner image, and then transfers the toner image onto a paper sheet. The paper sheet after the transfer process undergoes a fixing process of the toner image and then is discharged externally.

In recent years, along with progress of color printing and faster processing, structure of the image forming apparatus becomes complicated. In addition, in order to support faster processing, high speed rotation of a toner stirring member in the developing device is inevitable. In particular, in a developing method using two-component developer containing magnetic carrier and toner, a magnetic roller (toner supply roller) carrying developer, and a developing roller carrying only toner, in opposed position of the developing roller and the magnetic roller, only toner is carried by the developing roller with a magnetic brush formed on the magnetic roller, and further toner that was not used for developing is separated from the developing roller. Therefore, toner is apt to scatter in a vicinity of the opposed position of the developing roller and the magnetic roller, and toner floating in the developing device is deposited around periphery of the ear cutting blade (restricting blade). Then, the deposited toner coagulates and sticks to the developing roller, and hence toner drop occurs so that image malfunction may occur.

Therefore, for example, there is known a developing device using two-component developer containing magnetic carrier and toner, a magnetic roller for carrying developer, and a developing roller carrying only toner, in which the developing device includes a toner receiving support member facing the developing roller or the magnetic roller, a toner receiving member disposed along a longitudinal direction of the toner receiving support member so as to receive toner falling from the developing roller, and oscillation generation means for oscillating the toner receiving member.

SUMMARY

An image forming apparatus according to an aspect of the present disclosure includes an image carrier, an electrification device, an exposing device, a developing device, and a control unit. The image carrier has a surface on which a photosensitive layer is formed. The electrification device electrifies the surface of the image carrier. The exposing device emits light to the surface of the image carrier electrified by the electrification device so as to form an electrostatic latent image. The developing device includes a developing roller disposed to face the image carrier so as to supply toner to the image carrier, a developing container for storing developer containing the toner, and a seal member disposed at an opening of the developing container to contact with the image carrier so as to prevent leakage of the toner from a gap between the image carrier and the developing container, and the developing device develops the electrostatic latent image formed on the image carrier into a toner image. The control unit controls drive of the image carrier, the electrification device, the exposing device, and the developing device. The control unit is capable of executing a seal member cleaning mode, in which it forms an electrostatic latent image pattern having exposed parts and unexposed parts whose boundaries exist at a predetermined or less interval over the entire area in a width direction of an image forming area of the image carrier when an image is not being formed, and drives the image carrier to rotate so that the electrostatic latent image pattern passes the seal member.

Further features of the present disclosure and specific advantages obtained by the present disclosure will become more apparent from the description of embodiments given below.

DETAILED DESCRIPTION

Figure 1:
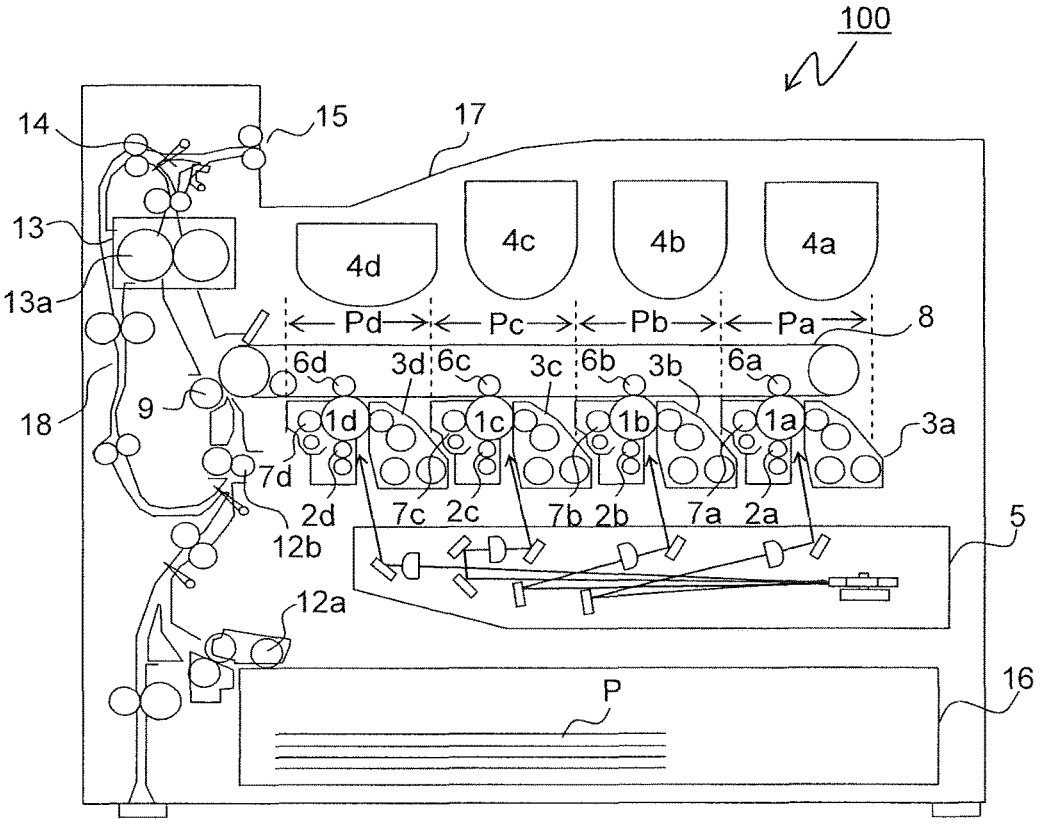
FIG. 1 is a schematic structural diagram of a color printer according to an embodiment of the present disclosure.

Hereinafter, with reference to the drawings, an embodiment of the present disclosure is described. FIG. 1 is a schematic cross-sectional view of an image forming apparatus according to an embodiment of the present disclosure, which is a tandem type color printer. In a main body of a color printer 100, four image forming units Pa, Pb, Pc, and Pd are disposed in order from an upstream side in a conveyance direction (right side in FIG. 1). These image forming units Pa to Pd are disposed corresponding to images of four different colors (cyan, magenta, yellow, and black), and sequentially form the cyan, magenta, yellow, and black images by electrifying, exposing, developing, and transferring steps each.

These image forming units Pa to Pd are provided with photosensitive drums 1*a*, 1*b*, 1*c*, and 1*d*, respectively, which carry visual images (toner images) of respective colors. Further, an intermediate transfer belt 8, which turns in a clockwise direction in FIG. 1, is disposed adjacent to the image forming units Pa to Pd.

When image data is input from a host device such as a personal computer, electrification devices 2*a* to 2*d* first electrify surfaces of the photosensitive drums 1*a* to 1*d* in a uniform manner. Next, an exposing device 5 irradiates the photosensitive drums 1*a* to 1*d* with light in accordance with the image data so as to form electrostatic latent images on the photosensitive drums 1*a* to 1*d* in accordance with the image data. Developing devices 3*a* to 3*d* are filled with two-component developer containing cyan, magenta, yellow, and black color toner, respectively (hereinafter referred to simply as developer) at a predetermined amount supplied from toner containers 4*a* to 4*d*, respectively. The toner in the developer is supplied from the developing devices 3*a* to 3*d* and is electrostatically adhered to the photosensitive drums 1*a* to 1*d*, respectively. In this way, the toner images are formed corresponding to the electrostatic latent images formed by exposure by the exposing device 5.

Then, primary transfer rollers 6*a* to 6*d* apply an electric field with a predetermined transfer voltage between the primary transfer rollers 6*a* to 6*d* and the photosensitive drums 1*a* to 1*d*, respectively, so that the cyan, magenta, yellow, and black toner images on the photosensitive drums 1*a* to 1*d* are primarily transferred onto the intermediate transfer belt 8. After the primary transfer, toner and the like remaining on the surfaces of photosensitive drums 1*a* to 1*d* are removed by cleaning devices 7*a* to 7*d*, respectively.

Paper sheets P to which the toner image is transferred are stored in a paper sheet cassette 16 disposed in a lower part of the image forming apparatus 100. The paper sheet P is conveyed via a feed roller 12*a* and a registration roller pair 12*b* to a nip portion between the intermediate transfer belt 8 and a secondary transfer roller 9 disposed adjacent to the intermediate transfer belt 8 (secondary transfer nip portion) at a predetermined timing. The paper sheet P with the secondarily transferred toner image is conveyed to a fixing unit 13.

The paper sheet P conveyed to the fixing unit 13 is heated and pressed by a fixing roller pair 13*a* so that the toner image is fixed to the surface of the paper sheet P, and thus a predetermined full color image is formed. The paper sheet P with the full color image is discharged by a discharge roller pair 15 onto a discharge tray 17 directly (or after being sent to a reverse conveying path 18 by a branch unit 14 and after images are formed on both sides).

Figure 2:
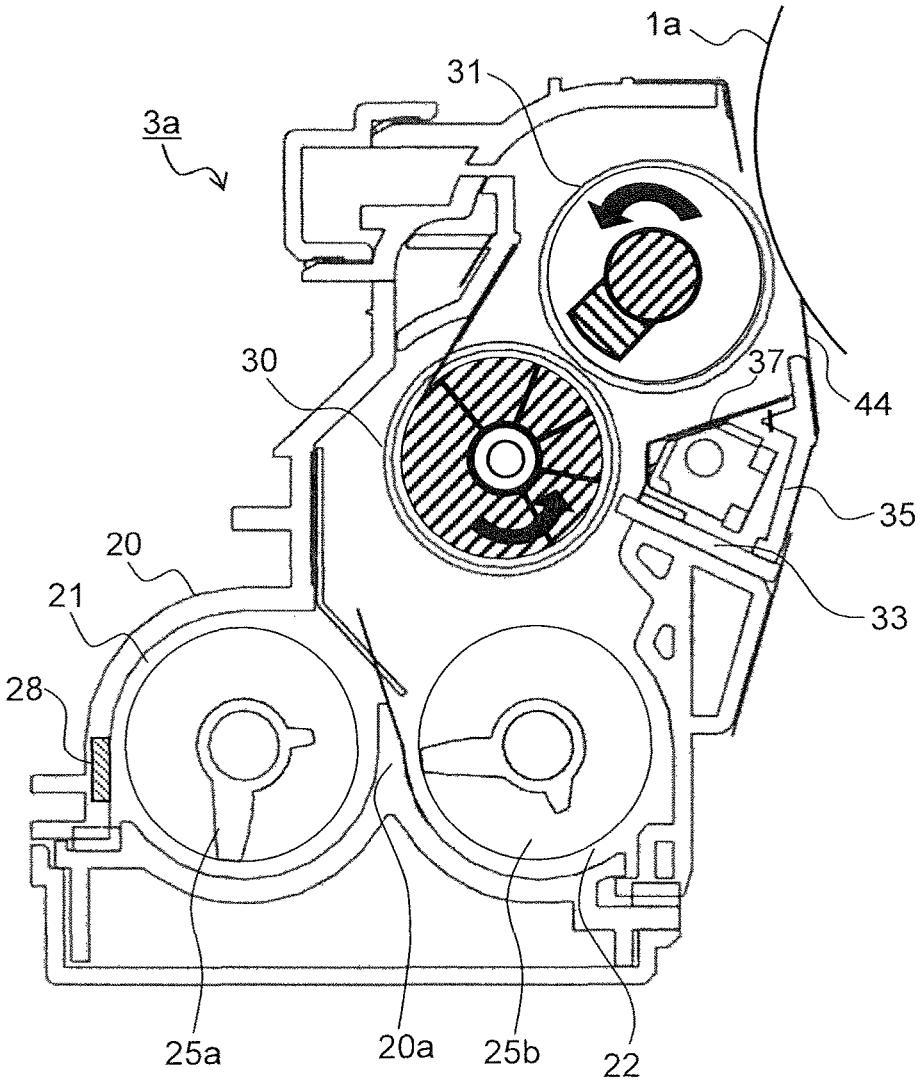
FIG. 2 is a cross-sectional side view of a developing device mounted in the color printer.

FIG. 2 is a cross-sectional side view of the developing device 3*a* mounted in the color printer 100. Note that FIG. 2 shows a state viewed from the rear side in FIG. 1, and positional relationship of members in the developing device 3*a* are opposite in the left and right direction between FIG. 2 and FIG. 1. In addition, the developing device 3*a* disposed in the image forming unit Pa of FIG. 1 is exemplified in the following description, and the developing devices 3*b* to 3*d* disposed in the image forming units Pb to Pd have the same structure as the developing device 3*a*, so description thereof is omitted.

As shown in FIG. 2, the developing device 3*a* includes a developing container (casing) 20 that stores two-component developer containing toner and magnetic carrier (hereinafter referred to simply as developer). The developing container 20 is divided by a partition wall 20*a* into a stirring transport chamber 21 and a supplying transport chamber 22. The stirring transport chamber 21 and the supplying transport chamber 22 are respectively provided with a stirring transport screw 25*a* and a supplying transport screw 25*b* in a rotatable manner, which mix and stir toner (positively electrified toner) supplied from the toner container 4*a* (see FIG. 1) with carrier for electrification.

Further, the developer is stirred and transported in an axial direction (perpendicular to the paper plane of FIG. 2) by the stirring transport screw 25*a* and the supplying transport screw 25*b*, and is circulated between the stirring transport chamber 21 and the supplying transport chamber 22 via developer passages (not shown) formed at both ends of the partition wall 20*a*. In other words, the stirring transport chamber 21, the supplying transport chamber 22, and the developer passages form a circulation path of the developer in the developing container 20.

The developing container 20 extends diagonally upward and rightward in FIG. 2. In the developing container 20, a toner supply roller 30 is disposed above the supplying transport screw 25*b*, and a developing roller 31 is disposed at the upper right of the toner supply roller 30 so as to face the same. Further, the developing roller 31 faces the photosensitive drum 1*a* on the opening side (right side in FIG. 2) of the developing container 20. The toner supply roller 30 and the developing roller 31 rotate about their respective rotation axes in a counterclockwise direction in FIG. 2.

In the stirring transport chamber 21, a toner concentration sensor 28 is disposed to face the stirring transport screw 25*a*. The toner concentration sensor 28 detects a ratio of the toner to the carrier (T/C) in the developer, and a magnetic permeability sensor for detecting magnetic permeability of the developer in the developing container 20 is used as the toner concentration sensor 28, for example. In this embodiment, the magnetic permeability of the developer is detected by the toner concentration sensor 28, and a voltage value corresponding to the detection result is output to a control unit 90 (see FIG. 3) described later. The control unit 90 determines the toner concentration on the basis of the output value of the toner concentration sensor 28. The control unit 90 sends a control signal to a toner replenishment motor (not shown) in accordance with the determined toner concentration, and a predetermined amount of toner is replenished from the toner container 4*a* to the stirring transport chamber 21 via a toner replenishment inlet (not shown).

The toner supply roller 30 is constituted of a non-magnetic rotation sleeve rotating in the counterclockwise direction in FIG. 2 and a fixed magnet body having a plurality of magnetic poles included in the rotation sleeve.

The developing roller 31 is constituted of a cylindrical developing sleeve rotating in the counterclockwise direction in FIG. 2 and a developing roller side magnetic pole fixed inside the developing sleeve. The toner supply roller 30 and the developing roller 31 are opposed to each other with a predetermined gap at a facing position (opposed position). The developing roller side magnetic pole has the opposite polarity to the opposed magnetic pole (main pole) of the fixed magnet body.

In addition, the developing container 20 is provided with an ear cutting blade 33 mounted along a longitudinal direction of the toner supply roller 30 (direction perpendicular to the paper plane of FIG. 2). The ear cutting blade 33 is positioned on an upstream side of the opposed position of the developing roller 31 and the toner supply roller 30 in the rotation direction of the toner supply roller 30 (the counterclockwise direction in FIG. 2). Further, a slight space (gap) is formed between the tip end portion of the ear cutting blade 33 and the surface of the toner supply roller 30.

The developing roller 31 is applied with a DC voltage (hereinafter referred to as Vslv(DC)) and an AC voltage (hereinafter referred to as Vslv(AC)). The toner supply roller 30 is applied with a DC voltage (hereinafter referred to as Vmag(DC)) and an AC voltage (hereinafter referred to as Vmag(AC)). These DC voltages and AC voltages are applied from a developing voltage power supply 53 (see FIG. 3) to the developing roller 31 and the toner supply roller 30 via a voltage control circuit 51 (see FIG. 3).

As described above, the developer is stirred by the stirring transport screw 25*a* and the supplying transport screw 25*b*, and is circulated between the stirring transport chamber 21 and the supplying transport chamber 22 in the developing container 20 so that the toner is electrified, and the developer is transported to the toner supply roller 30 by the supplying transport screw 25*b*. Then, a magnetic brush (not shown) is formed on the toner supply roller 30, and the magnetic brush on the toner supply roller 30 has a layer thickness restricted by the ear cutting blade 33. After that, the magnetic brush is transported to the opposed position of the toner supply roller 30 and the developing roller 31 so as to form a toner thin layer on the developing roller 31 due to a potential difference ΔV between Vmag(DC) applied to the toner supply roller 30 and Vslv(DC) applied to the developing roller 31, and the magnetic field.

The thickness of the toner layer on the developing roller 31 changes also depending on a resistance of the developer, a rotation speed difference between the toner supply roller 30 and the developing roller 31, and the like, but can be controlled by ΔV. When ΔV is increased, the toner layer on the developing roller 31 becomes thicker. When ΔV is decreased, the toner layer becomes thinner. An appropriate range of ΔV in the developing process is approximately 100 V to 350 V in general.

The toner thin layer formed on the developing roller 31 by contact with the magnetic brush on the toner supply roller 30 is transported to the opposed position (opposed regions) of the photosensitive drum 1*a* and the developing roller 31 by rotation of the developing roller 31. Because the developing roller 31 is applied with Vslv(DC) and Vslv(AC), the toner flies due to a potential difference between the developing roller 31 and the photosensitive drum 1*a*, and hence the electrostatic latent image on the photosensitive drum 1*a* is developed.

Toner remaining without being used is transported again to the opposed position of the developing roller 31 and the toner supply roller 30 and is collected by the magnetic brush on the toner supply roller 30. Further, the magnetic brush is separated from the toner supply roller 30 at the same polarity part of the fixed magnet body and then falls into the supplying transport chamber 22.

After that, on the basis of the detection result by the toner concentration sensor 28, a predetermined amount of toner is replenished through the toner replenishment inlet (not shown), and uniformly electrified two-component developer is obtained again at an appropriate toner concentration while it is circulated between the supplying transport chamber 22 and the stirring transport chamber 21. This developer is supplied to the toner supply roller 30 again by the supplying transport screw 25*b* so as to form the magnetic brush, which is transported to the ear cutting blade 33.

On the right side wall of the developing container 20 in a vicinity of the developing roller 31 in FIG. 2, there is disposed a toner receiving support member 35 having a triangular cross section protruding to the inside of the developing container 20. As shown in FIG. 2, the toner receiving support member 35 is disposed along the longitudinal direction of the developing container 20 (direction perpendicular to the paper plane of FIG. 2). An upper surface of the toner receiving support member 35 faces the toner supply roller 30 and the developing roller 31, and constitutes a wall portion inclined downward in the direction from the developing roller 31 to the toner supply roller 30. A toner receiving member 37, which receives toner separating and falling from the developing roller 31, is attached to the upper surface of the toner receiving support member 35 along the longitudinal direction.

Figure 3:
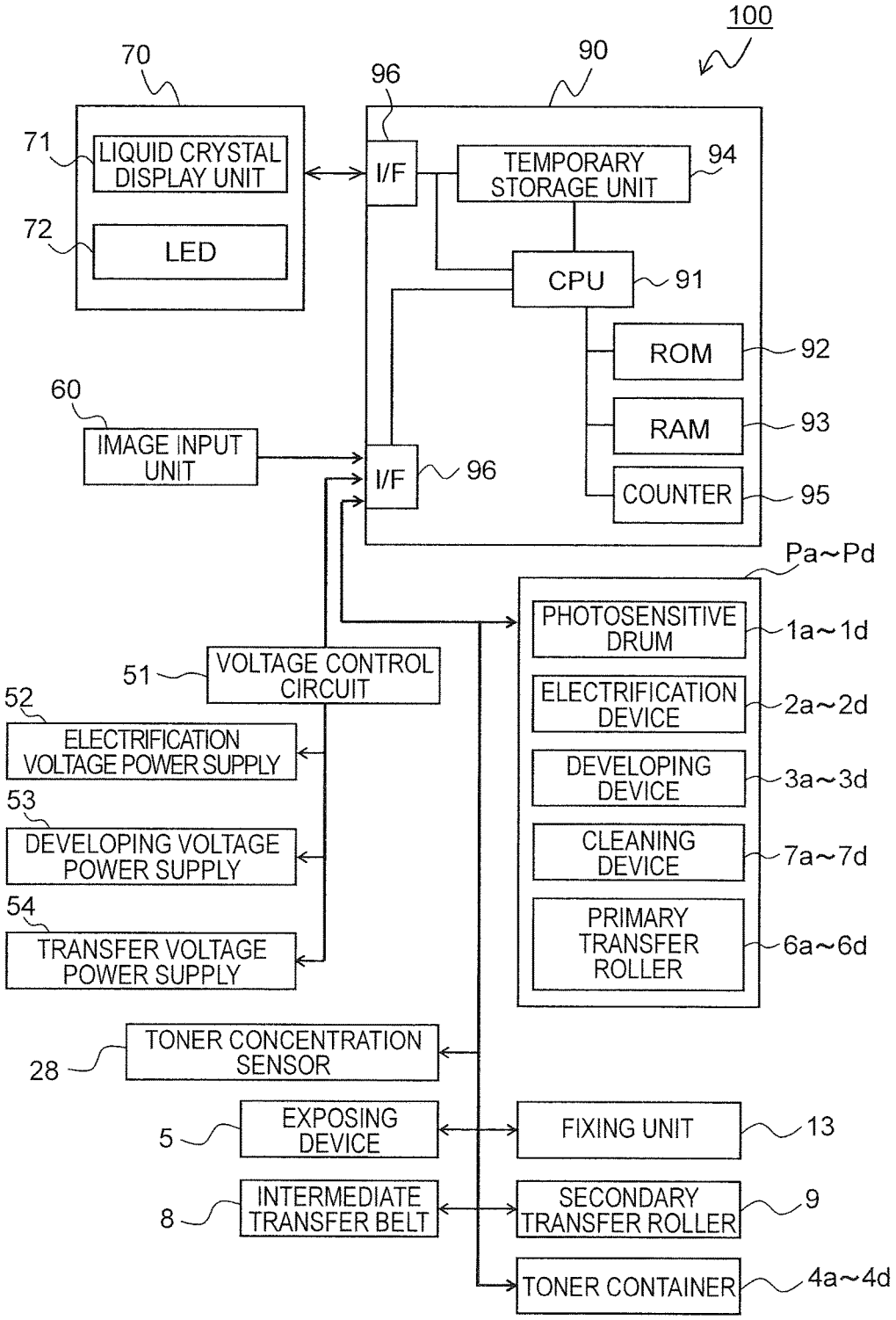
FIG. 3 is a block diagram illustrating an example of a control path used in the color printer.

FIG. 3 is a block diagram showing an example of the control path used by the color printer 100 of the present disclosure. Note that the control path of the entire color printer 100 is complicated because various controls of the individual units of the apparatus are performed when the color printer 100 is used. Accordingly, a part of the control path, which is necessary for performing the present disclosure, is mainly described.

A voltage control circuit 51 is connected to an electrification voltage power supply 52, a developing voltage power supply 53, and a transfer voltage power supply 54, so that output signals from the control unit 90 control these power supplies to work. As to these power supplies, on the basis of the control signals from the voltage control circuit 51, the electrification voltage power supply 52 applies a predetermined voltage to electrification rollers in the electrification devices 2*a* to 2*d*, the developing voltage power supply 53 applies a predetermined voltage to the toner supply roller 30 and the developing roller 31 in the developing devices 3*a* to 3*d*, and the transfer voltage power supply 54 applies a predetermined voltage to the primary transfer rollers 6*a* to 6*d* and the secondary transfer roller 9.

An image input unit 60 is a receiving unit that received image data transmitted from the personal computer or the like to the color printer 100. An image signal input from the image input unit 60 is converted into a digital signal and then is sent to a temporary storage unit 94.

An operation unit 70 is provided with a liquid crystal display unit 71 and an LED 72 for displaying various states such as a state of the color printer 100, an image forming situation, and the number of printed copies. Various settings of the color printer 100 are performed from a printer driver in the personal computer.

Other than that, the operation unit 70 is provided with a start button for instructing to start image forming by a user, a stop/clear button to be used for stopping image forming and the like, a reset button to be used for resetting various settings of the color printer 100 to default states, and the like.

The control unit 90 includes at least a central processing unit (CPU) 91, a read only memory (ROM) 92, a random access memory (RAM) 93 that is readable and writable, the temporary storage unit 94 for temporarily storing image data and the like, a counter 95, a plurality of (two in this example) interfaces (I/Fs) 96 for transmitting the control signals to the individual devices in the color printer 100 and receiving an input signal from an operation unit 70. In addition, the control unit 90 can be disposed at any position in the apparatus main body.

The ROM 92 stores data and the like such as a control program of the color printer 100 and values necessary for control, which is not changed during use of the color printer 100. The RAM 93 stores necessary data generated during control of the color printer 100 and data that is temporarily necessary for control of the color printer 100. In addition, the RAM 93 (or the ROM 92) also stores electrostatic latent image patterns to be formed on the photosensitive drums 1*a* to 1*d* in a seal member cleaning mode described later. The temporary storage unit 94 temporarily stores the image signal, which is input from the image input unit 60 for receiving the image data transmitted from the personal computer or the like and is converted into a digital signal. The counter 95 counts and accumulates the number of printed pages.

In addition, the control unit 90 transmits the control signals to the individual units and devices in the printer 100 from the CPU 91 via the I/F 96. In addition, the individual units and devices transmit signals indicating their states and the input signal to the CPU 91 via the I/F 96. The individual units and devices controlled by the control unit 90 include, for example, the image forming units Pa to Pd, the exposing device 5, the intermediate transfer belt 8, the secondary transfer roller 9, the fixing unit 13, the voltage control circuit 51, the image input unit 60, the operation unit 70, and the like.

Figure 4:
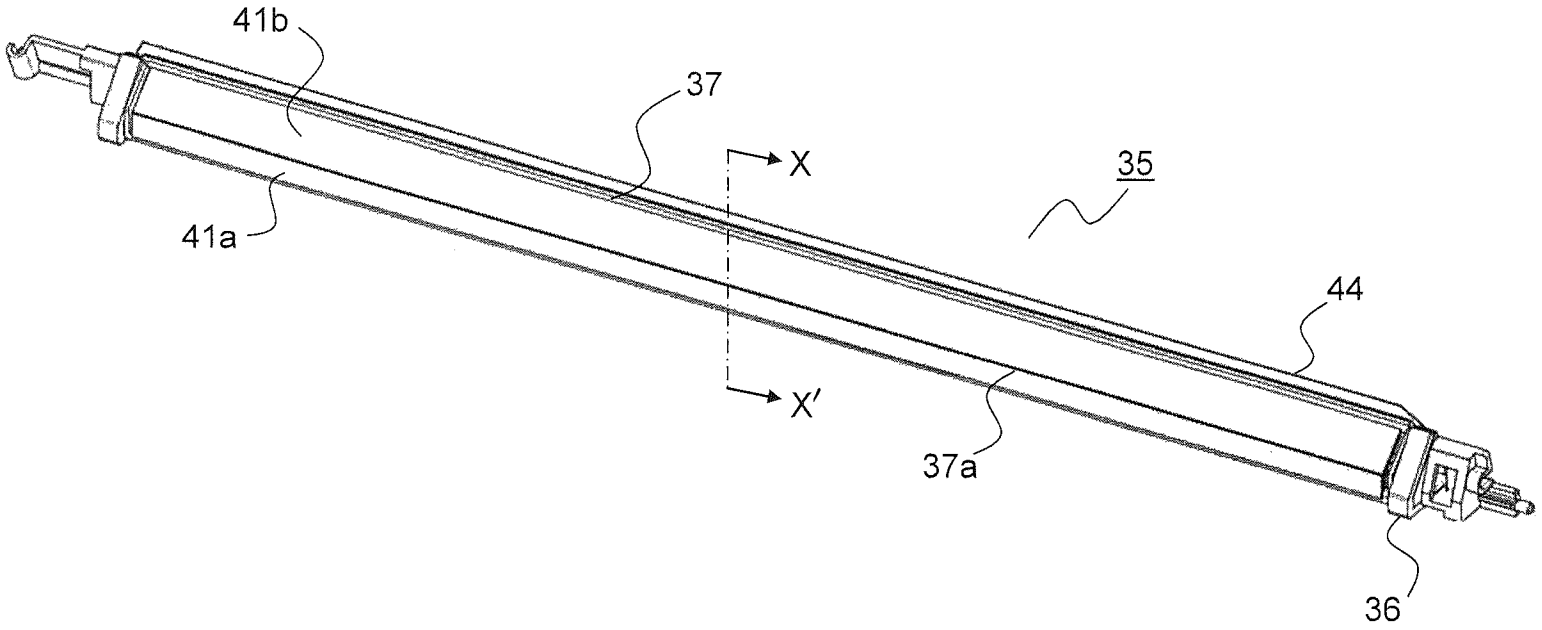
FIG. 4 is a perspective view of a toner receiving support member used in the developing device, which is viewed from the inside of a developing container.
Figure 5:
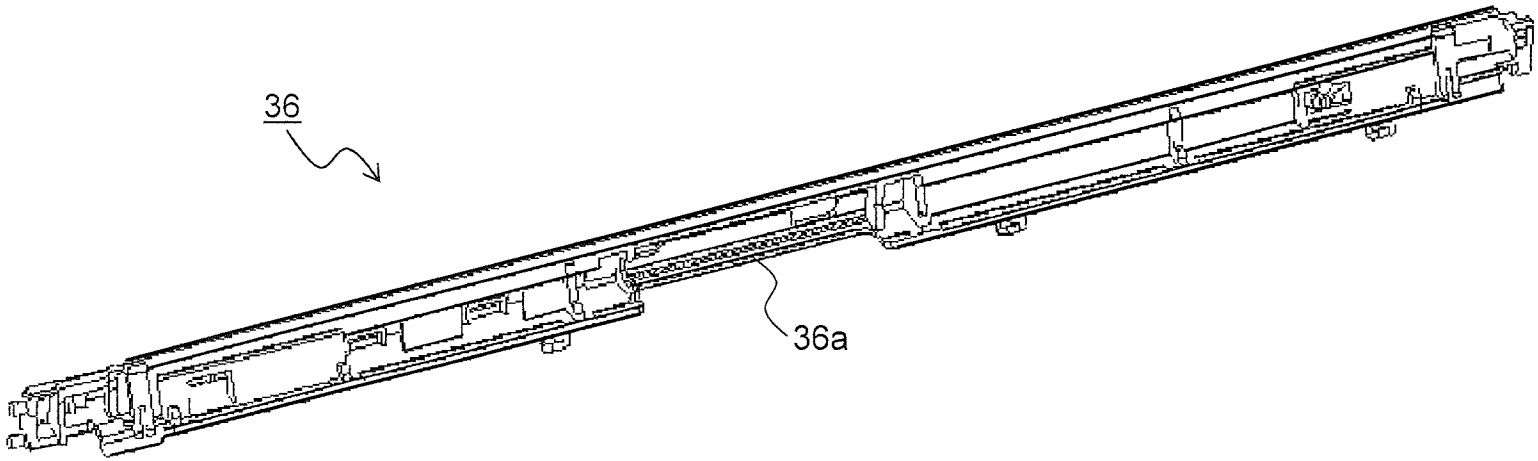
FIG. 5 is a perspective view of a support member main body constituting the toner receiving support member.
Figure 6:
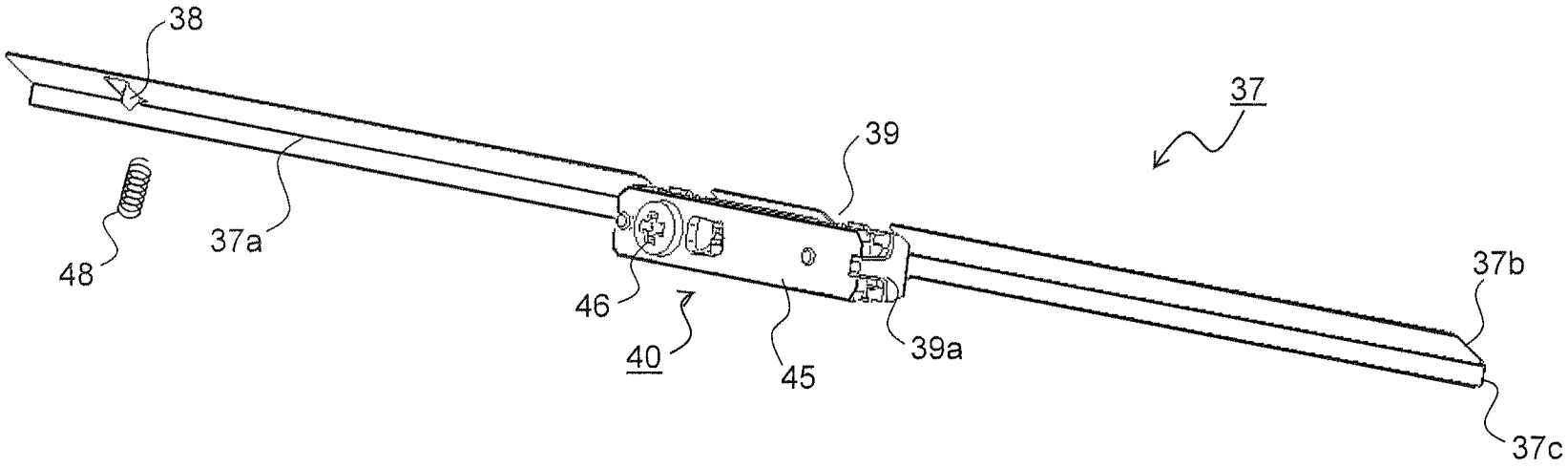
FIG. 6 is a perspective view of a toner receiving member constituting the toner receiving support member, which is viewed from rear side.

FIG. 4 is a perspective view of the toner receiving support member 35 used in the developing devices 3*a* to 3*d*, which is viewed from the inside of the developing container 20 (the left side in FIG. 2), FIG. 5 is a perspective view of a support member main body 36 constituting the toner receiving support member 35, and FIG. 6 is a perspective view of the toner receiving member 37 constituting the toner receiving support member 35, which is viewed from the inside of the toner receiving support member 35. Note that FIG. 5 shows the support member main body 36 viewed from the mounting direction of the toner receiving member 37.

The toner receiving support member 35 includes a resin support member main body 36, a sheet metal toner receiving member 37 supported by the support member main body 36 in a rocking manner, and an oscillation generation device 40 attached to the toner receiving member 37 at a substantially middle part in the longitudinal direction. The support member main body 36 is provided with a housing part 36*a* for housing the oscillation generation device 40 when the toner receiving member 37 is attached.

In addition, the upper end of the support member main body 36 is provided with a film-like seal member 44. The seal member 44 extends in the longitudinal direction of the support member main body 36 (the left and right direction of FIG. 4) so that the tip end portion thereof contacts with the surface of the photosensitive drum 1*a*, and has a function of shielding so that the toner inside the developing container 20 (see FIG. 2) cannot leak to the outside. As material of the seal member 44, there is urethane foam seat or the like.

The toner receiving member 37 has a bent shape including a bent part 37*a* formed along the longitudinal direction, and divided into a toner receiving surface 37*b* facing the developing roller 31 (see FIG. 2) and a toner fall surface 37*c* that is a substantially vertical surface facing the toner supply roller 30, with respect to the bent part 37*a* between them. One end side of the toner receiving member 37 in the longitudinal direction is provided with an engaging part 38 for engaging with a contact spring 48 for grounding (earthing) the toner receiving member 37. A lower end part of the contact spring 48 contacts with the ear cutting blade 33 (see FIG. 2) via a conductive spring receiving member (not shown). A holding unit 39 having a pair of holding claws 39*a* for holding the oscillation generation device 40 is formed in a substantially middle part of the toner receiving member 37 in the longitudinal direction. A substrate 45, on which circuits and electronic components (not shown) for controlling drive of an oscillation motor 43 (see FIG. 7) are mounted, is fixed to the oscillation generation device 40 by a screw 46.

Sheet members 41*a* and 41*b* are pasted to the surface of the toner receiving member 37 (surfaces facing the developing roller 31 and the toner supply roller 30). In order to prevent adhesion of the toner to the toner receiving member 37, the sheet members 41*a* and 41*b* are made of a material to which the toner is less easily adhered than the toner receiving member 37. A fluorocarbon resin or the like is used as a material of the sheet members 41*a* and 41*b*.

Figure 7:
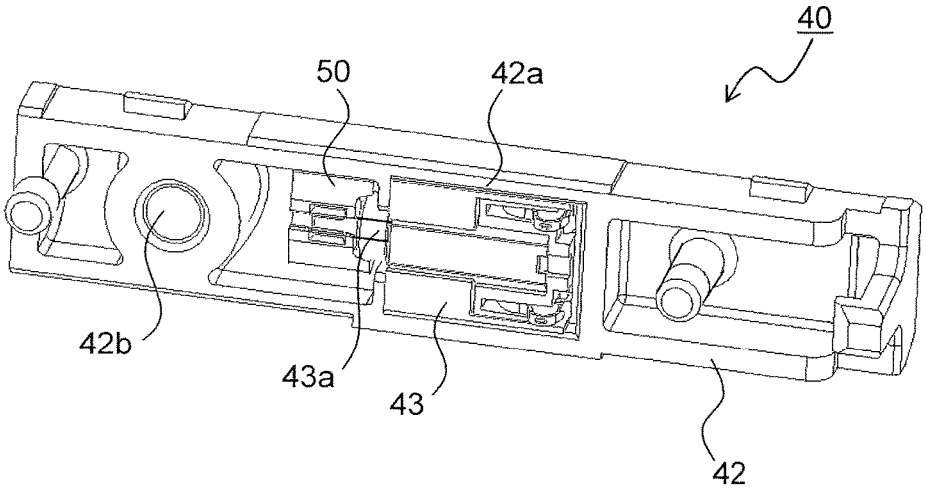
FIG. 7 is a perspective view illustrating an internal structure of an oscillation generation device mounted to the toner receiving member.

FIG. 7 is a perspective view of the oscillation generation device 40. Note that FIG. 7 shows a state where the substrate 45 (see FIG. 6) is removed from a motor attachment holder 42 so that the inside of an oscillation generation device 40 can be seen well. The oscillation generation device 40 includes the motor attachment holder 42 and the oscillation motor 43. The motor attachment holder 42 is provided with a motor holding unit 42*a* for holding the oscillation motor 43 and a screw hole 42*b* to which the screw 46 is fastened. An oscillating weight 50 is fixed to an output shaft 43*a* of the oscillation motor 43. When the oscillation generation device 40 is attached to the toner receiving member 37, the output shaft 43*a* of the oscillation motor 43 is fixed to be along the longitudinal direction of the toner receiving member 37. In addition, the motor attachment holder 42 is connected to lead wires (not shown) for supplying power to the oscillation motor 43.

The oscillating weight 50 has a cam shape, which is a partially cut-off disk shape viewed from a direction of the output shaft 43*a* of the oscillation motor 43 (the left direction in FIG. 7) and is an asymmetric shape with respect to the output shaft 43*a*. When the output shaft 43*a* rotates at a predetermined speed or higher, a centrifugal force acting on the cut-off part is smaller than that acting on the other part, and hence a nonuniform centrifugal force acts on the oscillating weight 50. When this centrifugal force is transmitted to the output shaft 43*a*, the oscillation motor 43 is oscillated. Note that the shape of the oscillating weight 50 is not limited to the cam shape but may be any shape that causes center of gravity shift with respect to the output shaft 43*a*.

Figure 8:
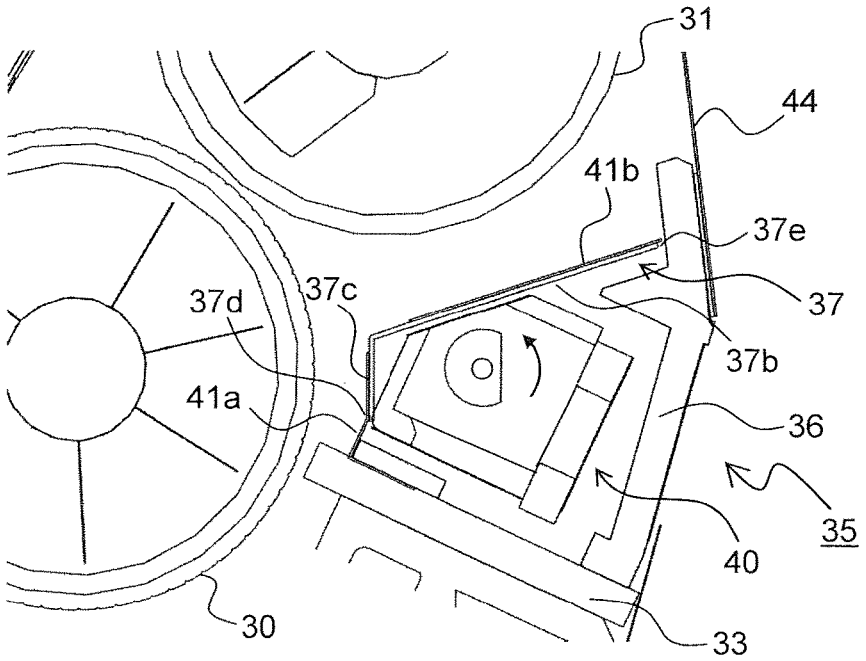
FIG. 8 is a cross-sectional side view of a periphery of the toner receiving support member of the developing device and illustrates a cross section of a periphery of an oscillation motor.
Figure 9:
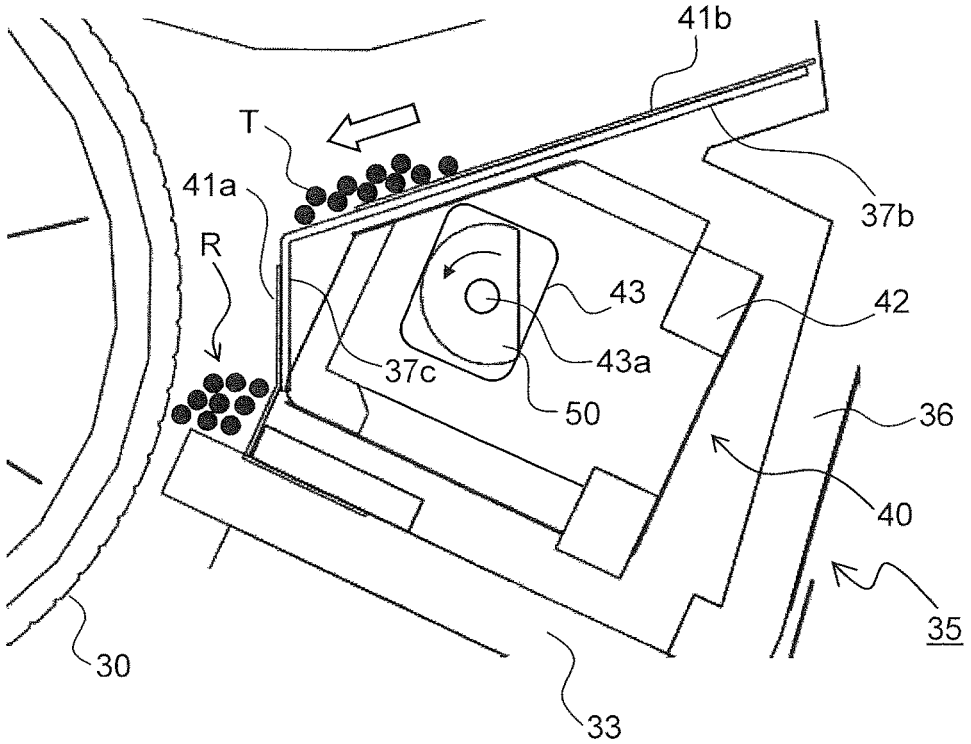
FIG. 9 is a partial enlarged view of the toner receiving support member in FIG. 8.

FIG. 8 is a cross-sectional side view showing a cross sectional structure (taken along a line XX' in FIG. 4) near the oscillation motor 43 of the toner receiving support member 35 used in the developing device 3*a*, and FIG. 9 is a partial enlarged view of the toner receiving support member 35 shown in FIG. 8.

As shown in FIGS. 8 and 9, the toner receiving member 37 contacts with the support member main body 36 only at an end edge 37*d* on the side near the toner supply roller 30, and an end edge 37*e* on the opposite side (near the photosensitive drum 1*a*) is a free end. Further, the substantially middle part of the toner receiving surface 37*b* in the width direction (the left and right direction in FIG. 9) is supported by the support member main body 36 via the oscillation generation device 40. In this way, the toner receiving member 37 is structured in a rocking manner with respect to the end edge 37*d* as a support point. In addition, the oscillation motor 43 is disposed so that the output shaft 43*a* is substantially parallel to the longitudinal direction of the toner receiving member 37.

The toner receiving member 37 is disposed so that the toner receiving surface 37*b* facing the developing roller 31 has a rising slope from the side close to the toner supply roller 30 to the side close to the photosensitive drum 1*a*, and that the toner fall surface 37*c* facing the toner supply roller 30 is substantially vertical.

The sheet member 41*a* is pasted to cover the surface of the toner receiving member 37 (toner fall surface 37*c*) including a boundary between the support member main body 36 on the ear cutting blade 33 side and the toner receiving member 37. In addition, the sheet member 41*b* is pasted to cover the entire area of the toner receiving surface 37*b* including a boundary between the support member main body 36 on the seal member 44 side and the toner receiving member 37, the engaging part 38, and the holding unit 39 (see FIG. 6). The sheet members 41*a* and 41*b* prevent the toner from adhering to the toner receiving surface 37*b* and the toner fall surface 37*c*, and also prevent leakage of the toner from the boundary between the toner receiving support member 35 and the toner receiving member 37, entering of the toner to the inside of the toner receiving support member 35, and malfunction of the oscillation motor 43 due to entering of the toner.

By rotating the output shaft 43*a* of the oscillation motor 43 at high speed (e.g., at approximately 10,000 rpm) when an image is not being formed, the oscillating weight 50 is also rotated at high speed together with the output shaft 43*a*. In this case, because the nonuniform centrifugal force is applied to the oscillating weight 50, the oscillation generation device 40 including the oscillation motor 43 and the motor attachment holder 42 is oscillated via the output shaft 43*a*. Further, the toner receiving member 37 to which the oscillation generation device 40 is attached is also oscillated. Specifically, the toner receiving surface 37*b* of the toner receiving member 37 is oscillated so that the amplitude becomes larger as being closer to the end edge 37*e* from the end edge 37*d* as the support point.

As shown in FIG. 9, due to the oscillation of the toner receiving surface 37*b*, toner T deposited on the toner receiving surface 37*b* slips down along the slope of the toner receiving surface 37*b* in the downward direction (a white arrow direction shown in FIG. 9) and falls freely to an area R between the substantially vertical toner fall surface 37*c* and the toner supply roller 30. A part of the toner fallen to the area R passes through a gap between the ear cutting blade 33 and the toner supply roller 30 as it is and falls into the supplying transport chamber 22.

The toner separated and fallen from the developing roller 31 is also adhered to the tip end of the seal member 44 provided to the upper end of the support member main body 36. When the oscillation generation device 40 oscillates, the seal member 44 also oscillates slightly via the support member main body 36, but the toner adhered to the tip end of the seal member 44 does not fall onto the toner receiving member 37 though it is loosen. As a result, the toner is accumulated little by little on the tip end of the seal member 44. Further, when the mass of the deposited toner moves to the photosensitive drum 1*a*, a toner drop is caused so that an image defect may occur.

Accordingly in this embodiment, when an image is not being formed, the seal member cleaning mode can be performed so as to remove the toner adhered to the seal member 44. Hereinafter, an execution procedure of the seal member cleaning mode in the developing device 3*a* is described in detail. Note that the seal member cleaning mode is executed also in the developing devices 3*b* to 3*d* in the exactly same procedure.

When the seal member cleaning mode is executed, the electrification device 2*a* (see FIG. 1) first electrifies the surface of the photosensitive drum 1*a* in a uniform manner. Next, the exposing device 5 (see FIG. 1) forms a predetermined electrostatic latent image pattern on the surface of the photosensitive drum 1*a*. Further, the photosensitive drum 1*a* is rotated so that the formed electrostatic latent image pattern passes the seal member 44. Because the tip end of the seal member 44 is contacted with the photosensitive drum 1*a*, the toner adhered to the tip end of the seal member 44 develops the electrostatic latent image by an edge effect (edge electric field) of the electrostatic latent image. In this way, the toner adhered to the seal member 44 is collected to the photosensitive drum 1*a* side.

Figure 10:
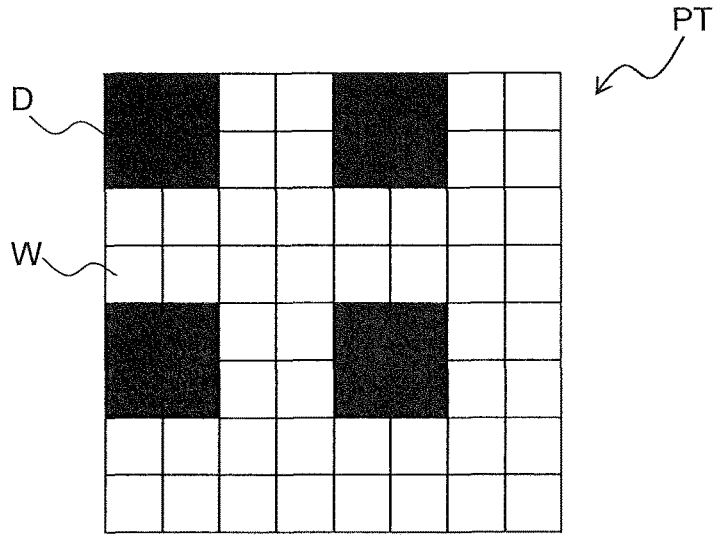
FIG. 10 is a diagram showing a dot pattern of four dots and 25% as an example of an electrostatic latent image pattern formed in a seal member cleaning mode.

FIG. 10 is a diagram showing an example of an electrostatic latent image pattern PT formed in the seal member cleaning mode, which is a dot pattern having a diameter (each side) of four dots and a printing rate of 25% (hereinafter referred to as four dots and 25%). The electrostatic latent image pattern PT shown in FIG. 10 is constituted of blocks each of which includes 16 (4 by 4) dots of a resolution of 600 dpi (1 dot=0.042 mm), in which 4 (2 by 2) dots (25%) form an exposed part D while the other 12 (16-4) dots form an unexposed part (white background part) W, and the blocks are formed continuously in a main scanning direction (the left and right direction in FIG. 10) and in a sub-scanning direction (up and down direction in FIG. 10).

Figure 11A:
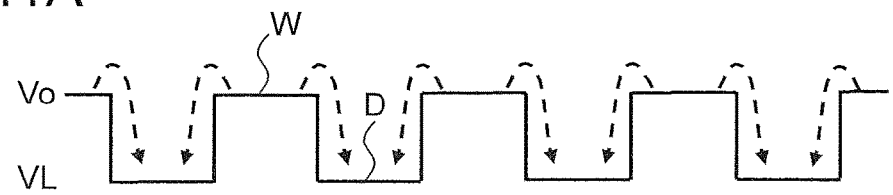
FIG. 11A is a graph for comparing edge effects by an electrostatic latent image pattern, which shows an edge effect of the dot pattern of four dots and 25% shown in FIG. 10.
Figure 11B:
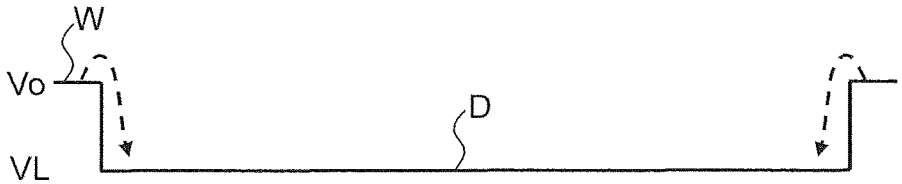
FIG. 11B is a graph for comparing edge effects by an electrostatic latent image pattern, which shows an edge effect of an electrostatic latent image pattern of a solid filled image (solid image).
Figure 11C:
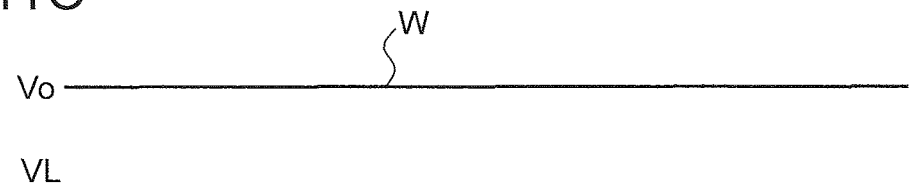
FIG. 11C is a graph for comparing edge effects by an electrostatic latent image pattern, which shows an edge effect of an electrostatic latent image pattern of a white background image.

FIGS. 11A to 11C are graphs for comparing the edge effect by the electrostatic latent image pattern PT. FIG. 11A shows the dot pattern of four dots and 25% shown in FIG. 10, in which the surface potential of the photosensitive drum 1*a* rapidly decreases from a white background part (unexposed part) potential (bright potential) Vo to an exposed part potential (dark potential) VL, because of the edge effect (broken line arrow) at the edge part (boundary) of the electrostatic latent image. In the dot pattern, the edge part exists over the entire area of the pattern, and hence the edge effect also appears over the entire area of the pattern. On the basis of the edge effect, the toner adhered to the entire area of the seal member 44 develops the dot pattern and moves to the photosensitive drum 1*a* side.

FIG. 11B shows the electrostatic latent image pattern of a solid filled image (solid image), and FIG. 11C shows the electrostatic latent image pattern of the white background image. The solid filled image has the edge parts (boundaries) only on both ends of the exposed part D as shown in FIG. 11B, and the white background image has only the unexposed part W and has no edge part as shown in FIG. 11C, and hence the toner on the seal member 44 cannot be cleaned by edge effect of the electrostatic latent image.

Figure 12:
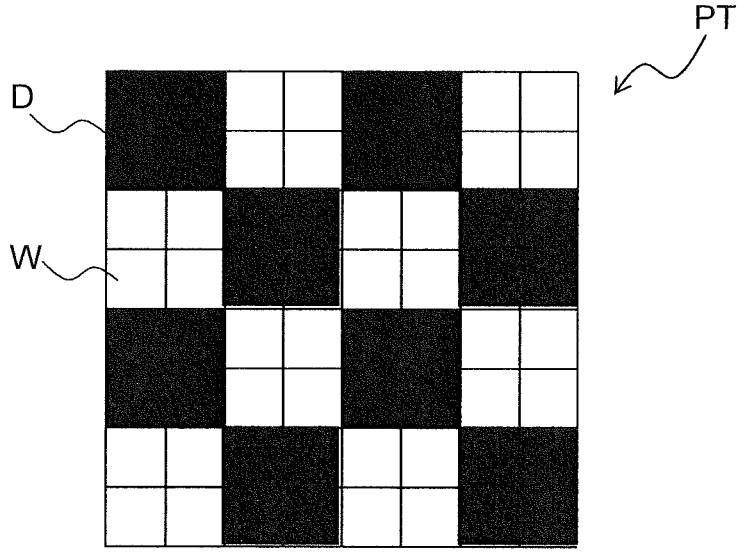
FIG. 12 is a diagram showing a dot pattern of four dots and 50% as another example of the electrostatic latent image pattern formed in the seal member cleaning mode.

FIG. 12 is a diagram showing another example of the electrostatic latent image pattern PT, which is a dot pattern of four dots and 50%. The electrostatic latent image pattern PT shown in FIG. 12 is constituted of blocks each of which includes 16 (4 by 4) dots of a resolution of 600 dpi (1 dot=0.042 mm), in which 8 (2 by 2 by 2) dots (50%) form the exposed part D while the other 8 (16-8) dots form the unexposed part (white background part) W, and the blocks are formed continuously in the main scanning direction (the left and right direction in FIG. 12) and in the sub-scanning direction (up and down direction in FIG. 12).

In FIG. 12, the exposed parts D are arranged in a zig-zag manner, and hence the edge part (boundary) appears more frequently in the main scanning direction and in the sub-scanning direction than the electrostatic latent image pattern PT shown in FIG. 10. Therefore, the edge effect shown in FIG. 11 becomes higher, and hence the toner adhered to the seal member 44 can be collected more effectively. Note that the dot pattern is not limited to that of four dots but may be a dot pattern of 1 dot 25%, for example.

As the electrostatic latent image pattern PT, the dot pattern shown in FIG. 10 or 12 has the highest cleaning effect, but these are not limitations. It is possible to use other patterns as long as there are edges of the exposed part and the white background part (unexposed part) at a predetermined or less interval. For example, a line pattern having a width of one dot to two dots has also the effect.

Figure 13:
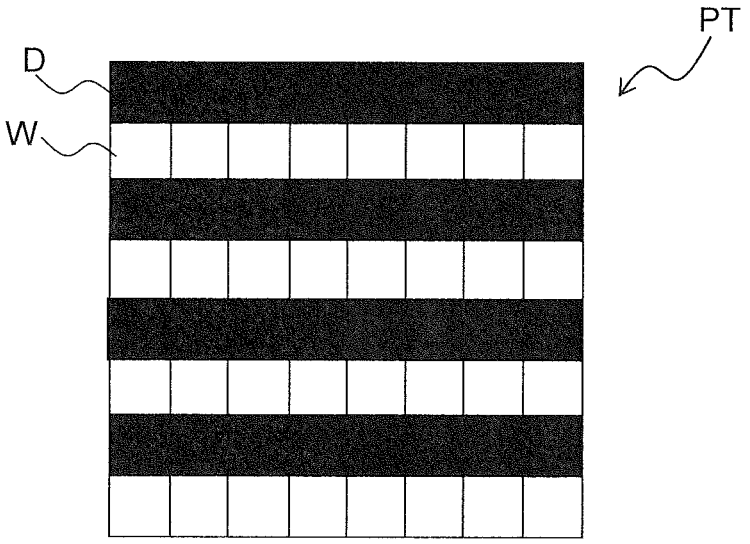
FIG. 13 is diagram showing a line pattern having a width of one dot parallel to a main scanning direction as another example of the electrostatic latent image pattern formed in the seal member cleaning mode.
Figure 14:
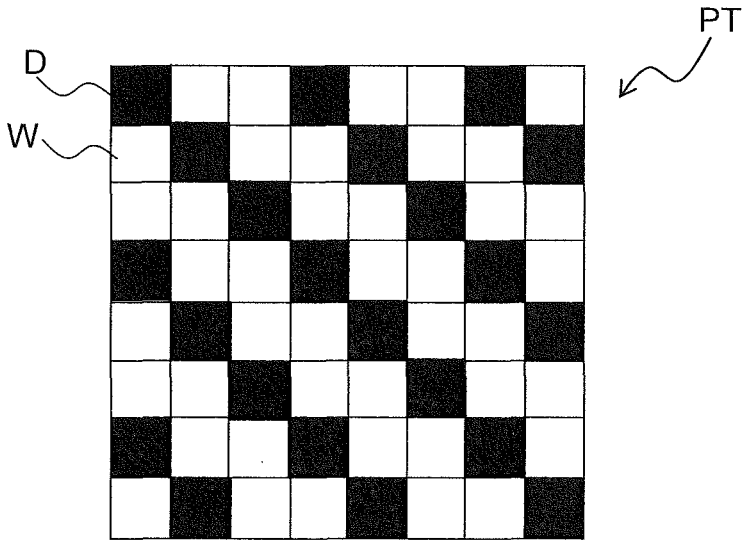
FIG. 14 is a diagram showing a diagonal line pattern having a width of one dot as another example of the electrostatic latent image pattern formed in the seal member cleaning mode.

When the electrostatic latent image pattern PT is the line pattern, the appearance ratio of the edge part (boundary) in the main scanning direction is increased by using a line pattern parallel to the main scanning direction as shown in FIG. 13 or a diagonal line pattern having a predetermined angle with respect to the sub-scanning direction as shown in FIG. 14. Thus, the toner adhered to the seal member 44 can be collected more effectively.

In addition, in order to clean the toner adhered to the entire area in the longitudinal direction of the seal member 44, it is necessary to form the electrostatic latent image pattern PT over the entire area in the width direction (drum axis direction) of the image forming area of the photosensitive drum 1*a* facing the seal member 44.

In addition, in order to enhance the cleaning effect of the toner adhered to the seal member 44, the electrification voltage applied to the electrification device 2*a* when forming the electrostatic latent image pattern PT is set higher than that when forming an image, and hence the surface potential of the photosensitive drum 1*a* (bright potential) Vo when forming the electrostatic latent image pattern PT is set higher than that when forming an image. In addition, the intensity of light emitted from the exposing device 5 to the photosensitive drum 1*a* is set higher when forming the electrostatic latent image pattern PT than when forming an image, and hence the exposed part potential (dark potential) VL of the photosensitive drum 1*a* is set lower when forming the electrostatic latent image pattern PT than when forming an image. In this way, because the potential difference ΔV (=Vo−VL) at the edge part of the electrostatic latent image becomes large, the edge effect is enhanced so that the cleaning effect of the seal member 44 can be improved more.

In addition, by oscillating the oscillation generation device 40 when executing the seal member cleaning mode, the toner adhered to the seal member 44 can be loosened. As a result, the toner can easily move from the seal member 44 to the photosensitive drum 1*a*, so that cleaning effect of the seal member 44 is improved.

The seal member cleaning mode may be executed every time when the printing operation is finished, or at timing when the number of continuously printed pages or accumulated printed pages reaches a predetermined number, or at other predetermined timing. In addition, by executing the seal member cleaning mode every time when the number of printed pages reaches a predetermined number, the seal member 44 is automatically cleaned in accordance with the number of printed pages. Therefore, it is not necessary for the user to manually set cleaning of the seal member 44, and it is possible to avoid setting error or forgetting to set, or to avoid unnecessary cleaning of the seal member.

Note that it is sufficient that at least the photosensitive drum 1*a* rotates so that the electrostatic latent image pattern passes the seal member 44 during the execution of the seal member cleaning mode, and the members of the developing device 3*a* (the toner supply roller 30, the developing roller 31, and the like) may not be driven. In addition, if the voltage is applied to the toner supply roller 30 and the developing roller 31 during the execution of the seal member cleaning mode, the electrostatic latent image pattern is developed by the toner from the developing roller 31, and hence the cleaning effect of the seal member 44 is deteriorated, and further the toner is unnecessarily consumed. Therefore, the voltage to be applied to the toner supply roller 30 and the developing roller 31 is turned off during the execution of the seal member cleaning mode.

Other than that, the present disclosure is not limited to the embodiment described above but can be variously modified within the scope of the present disclosure without deviating from the spirit thereof. For example, the shapes and structures of the toner receiving support member 35 and the toner receiving member 37 described in the above embodiment are merely examples and may be appropriately set in accordance with the apparatus structure or the like without being limited to the embodiment.

In addition, in the embodiment described above, the present disclosure is applied to the developing devices 3*a* to 3*d*, each of which uses the two-component developer, forms the magnetic brush on the toner supply roller 30, allows only the toner to move from the toner supply roller 30 to the developing roller 31, and supplies the toner from the developing roller 31 to the photosensitive drums 1*a* to 1*d*. However, the present disclosure can also be applied to a developing device of the two-component developing method, in which the toner supply roller 30 is not used, a magnetic brush formed on the outer circumferential surface of the developing roller 31 is used for developing the electrostatic latent images on the photosensitive drums 1*a* to 1*d*. Hereinafter, using examples, the effect of the present disclosure is further described in detail.

The cleaning effect of the seal member 44 in the case where the seal member cleaning mode was executed was studied. As a test machine, the color printer 100 (TASKalfa7551ci manufactured by KYOCERA Document Solutions Inc.) shown in FIG. 1 was used, which includes the developing devices 3*a* to 3*d* shown in FIG. 2. Further, the number of occurrence of toner drop on a halftone image was compared between a case where a halftone image was continuously printed on A3 paper sheets, the printing was stopped every 500 pages during the continuous printing so as to execute the seal member cleaning mode, or the seal member cleaning mode was executed every accumulated 50 printed pages after the job was finished (Example 1, Example 2) and a case where the seal member cleaning mode was not executed (Comparative example).

In the seal member cleaning mode, the voltage to be applied to the toner supply roller 30 and the developing roller 31 was turned off, and the electrostatic latent image pattern PT of four dots and 25% shown in FIG. 10 was formed on the surfaces of the photosensitive drums 1*a* to 1*d*. After that, the photosensitive drums 1*a* to 1*d* were rotated so that the electrostatic latent image pattern PT should pass the seal member 44. In addition, the oscillation generation device 40 was oscillated simultaneously with the execution of the seal member cleaning mode.

As conditions of the test machine, the surface potential of the photosensitive drums 1*a* to 1*d* in image formation was set to 230 V, and the surface potential of the photosensitive drums 1*a* to 1*d* in the seal member cleaning mode in Example 1 was set to the same 230 V as that in image formation. In addition, the surface potential of the photosensitive drums 1*a* to 1*d* in the seal member cleaning mode in Example 2 was set to 370 V. In addition, when the light intensity of the exposing device 5 in image formation was set to 100%, the light intensity of the exposing device 5 in the seal member cleaning mode in Example 1 was set to the same 100% as that in image formation. In addition, the light intensity of the exposing device 5 in the seal member cleaning mode in Example 2 was set to 150%. The result is shown in FIGS. 15 and 16.

Figure 15:
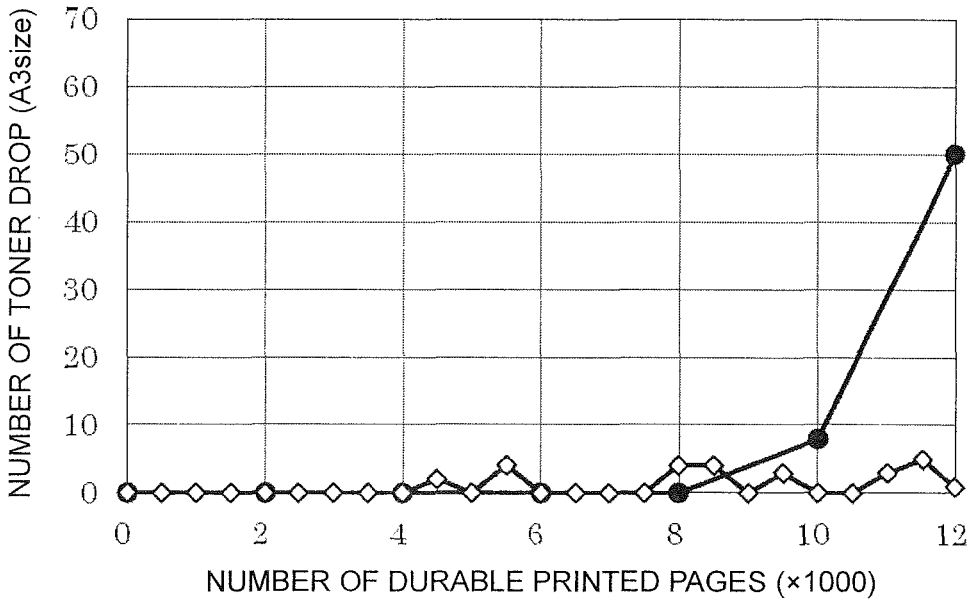
FIG. 15 is a graph for comparing the number of occurrence of toner drop on a halftone image between a case where the seal member cleaning mode is performed in the example (Example 1) and a case where the seal member cleaning mode is not performed (Comparative example).

It is clear from FIG. 15 that in Example 1 in which the seal member cleaning mode was performed (data series of ◇), the accumulated number of occurrence of toner drop after printing 12,000 pages is 26, and occurrence frequency of toner drop per continuous printing of 1,000 pages is 2.2. On the other hand, in Comparative example in which the seal member cleaning mode was not performed (data series of ●), occurrence of toner drop is rapidly increased after printing 8,000 pages, the accumulated number of occurrence of toner drop after printing 12,000 pages is 58, and occurrence frequency of toner drop per continuous printing of 1,000 pages is 4.8. It is confirmed from this result that occurrence of toner drop can be effectively reduced after durable printing by performing the seal member cleaning mode.

Figure 16:
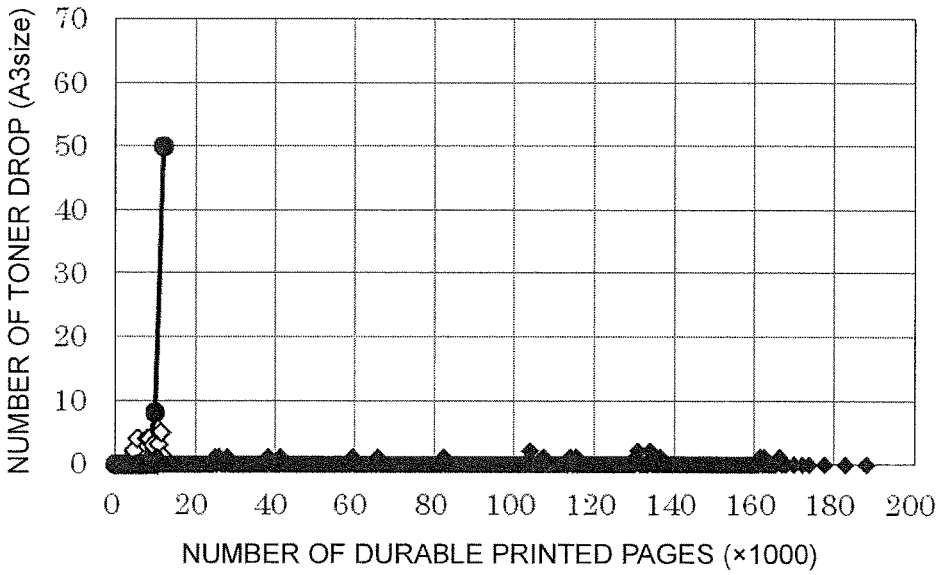
FIG. 16 is a graph for comparing the number of occurrence of toner drop on a halftone image between a case where the seal member cleaning mode is performed in the example (Example 1, Example 2) and a case where the seal member cleaning mode is not performed (Comparative example).

In addition, it is clear from FIG. 16 that in Example 2 in which the surface potential of the photosensitive drums 1*a* to 1*d* and the light intensity of the exposing device 5 are increased when the seal member cleaning mode is executed (data series of ◆), the accumulated number of occurrence of toner drop after printing 180,000 pages is 22, and occurrence frequency of toner drop per continuous printing of 1,000 pages is 0.1. It is confirmed from this result that occurrence of toner drop can be reduce more effectively by increasing the surface potential of the photosensitive drums 1*a* to 1*d* and the light intensity of the exposing device 5 when the seal member cleaning mode is executed.

The present disclosure can be used for an image forming apparatus equipped with the seal member for preventing toner scattering, at an opening of the developing device at which the developing roller facing the image carrier is exposed. By using the present disclosure, it is possible to provide an image forming apparatus capable of effectively collect the toner deposited on the seal member.

What is claimed is:

1. An image forming apparatus comprising:

an image carrier having a surface on which a photosensitive layer is formed;

an electrification device for electrifying the surface of the image carrier;

an exposing device for emitting light to the surface of the image carrier electrified by the electrification device so as to form an electrostatic latent image;

a developing device including a developing roller disposed to face the image carrier so as to supply toner to the image carrier, a developing container for storing developer containing the toner, and a seal member disposed at an opening of the developing container to contact with the image carrier so as to prevent leakage of the toner from a gap between the image carrier and the developing container, the developing device developing the electrostatic latent image formed on the image carrier into a toner image; and a control unit for controlling drive of the image carrier, the electrification device, the exposing device, and the developing device, wherein the control unit is capable of executing a seal member cleaning mode, in which it forms an electrostatic latent image pattern having exposed parts and unexposed parts whose boundaries exist at a predetermined or less interval over the entire area in a width direction of an image forming area of the image carrier when an image is not being formed, and drives the image carrier to rotate so that the electrostatic latent image pattern passes the seal member, and the control unit sets at least one of a surface potential of the image carrier or intensity of light emitted from the exposing device to the image carrier when the electrostatic latent image pattern is formed to be higher than that in image formation.

2. The image forming apparatus according to claim 1, wherein the control unit sets the surface potential of the image carrier to be 140 V or more higher, and the intensity of light emitted from the exposing device to the image carrier to be by half or more higher, when the electrostatic latent image pattern is formed to be higher than that in image formation.

3. The image forming apparatus according to claim 1, wherein the electrostatic latent image pattern is a dot pattern having a diameter of one to four dots and a printing rate of 25%.

4. The image forming apparatus according to claim 1, wherein the electrostatic latent image pattern is a zig-zag dot pattern having a diameter of one to four dots and a printing rate of 50%.

5. The image forming apparatus according to claim 1, wherein the electrostatic latent image pattern is a line pattern having a width of one to two dots.

6. The image forming apparatus according to claim 5, wherein the line pattern is constituted of diagonal lines having a predetermined angle with respect to a sub-scanning direction.

7. The image forming apparatus according to claim 1, wherein the developing device includes a support member for supporting the seal member and an oscillation generation device for oscillating the support member, and the control unit controls the oscillation generation device to oscillate the seal member via the support member during execution of the seal member cleaning mode.

8. The image forming apparatus according to claim 7, wherein the developing device includes a toner supply roller disposed to face the developing roller so as to supply toner to the developing roller at a region facing the developing roller, and a toner receiving member disposed along a longitudinal direction of the support member facing the developing roller or the toner supply roller so as to receive toner falling from the developing roller, and the oscillation generation device oscillates the toner receiving member.

9. The image forming apparatus according to claim 8, wherein the control unit turns off a voltage to be applied to the developing roller and the toner supply roller, during the execution of the seal member cleaning mode.

10. The image forming apparatus according to claim 1, wherein, in the electrostatic latent image pattern, dots forming the exposed parts have a diameter of 0.042 mm or more but 0.084 mm or less.

* * * * *